US012325889B2

(12) United States Patent
Sarkar et al.

(10) Patent No.: US 12,325,889 B2
(45) Date of Patent: Jun. 10, 2025

(54) HOT ROLLED STEEL SHEET AND A METHOD OF MANUFACTURING THEREOF

(71) Applicant: ArcelorMittal, Luxembourg (LU)

(72) Inventors: Sujay Sarkar, Metz (FR); Xavier Bano, Istres (FR); Guillaume Marcireau, Istres (FR); Blandine Oehler, Pont-à-Mousson (FR)

(73) Assignee: ArcelorMittal, Luxembourg (LU)

( * ) Notice: Subject to any disclaimer, the term of this patent is extended or adjusted under 35 U.S.C. 154(b) by 727 days.

(21) Appl. No.: 17/279,546

(22) PCT Filed: Sep. 2, 2019

(86) PCT No.: PCT/IB2019/057381
§ 371 (c)(1),
(2) Date: Mar. 24, 2021

(87) PCT Pub. No.: WO2020/065422
PCT Pub. Date: Apr. 2, 2020

(65) Prior Publication Data

US 2021/0340642 A1 Nov. 4, 2021

(30) Foreign Application Priority Data

Sep. 28, 2018 (WO) ..... PCT/IB2018/057549

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 6,488,790 | B1 | 12/2002 | Hartmann et al. |
| 6,554,919 | B2 | 4/2003 | Bano et al. |
| 8,657,969 | B2 | 2/2014 | Kawasaki et al. |
| 10,428,400 | B2 | 10/2019 | Drillet et al. |
| 2012/0211128 | A1 | 8/2012 | Corquillet |
| 2014/0120371 | A1 | 5/2014 | Mbacke et al. |
| 2014/0234657 | A1 | 8/2014 | Azuma et al. |
| 2016/0076124 | A1 | 3/2016 | Yamazaki et al. |

FOREIGN PATENT DOCUMENTS

| | | | | |
|---|---|---|---|---|
| CN | 103827341 | A | | 5/2014 |
| CN | 104513930 | A | | 4/2015 |
| CN | 105102662 | A | | 11/2015 |
| EP | 1138796 | | | 10/2001 |
| EP | 2171112 | B1 | | 11/2011 |
| EP | 2987884 | A1 | | 2/2016 |
| JP | 2000282175 | A | * | 10/2000 |
| JP | 2008 202119 | A | | 9/2008 |
| JP | 2008266792 | A | | 11/2008 |
| JP | 2013227603 | A | | 11/2013 |

(Continued)

OTHER PUBLICATIONS

English machine translation of JP 2000-282175 A of KAWABE (Year: 2000).*

(Continued)

*Primary Examiner* — Jophy S. Koshy
(74) *Attorney, Agent, or Firm* — Davidson Kappel LLC

(57) ABSTRACT

A hot rolled steel sheet having a composition including the elements, expressed in percentage by weight 0.11%≤Carbon≤0.16%, 1%≤Manganese≤2%, 0.1%≤Silicon≤0.7%, 0 02%≤Aluminum≤0.1%, 0.15%≤Molybdenum≤0.4%, 0.15%≤Vanadium≤0.4%, 0.002%≤Phosphorus≤0.02%, 0%≤Sulfur≤0.005%, 0%≤Nitrogen≤0.01%, and can contain one or more of the following optional elements 0%≤Chromium≤0.5%, 0%≤Niobium≤0.05%, 0.0001%≤Calcium≤0.005%, 0%≤Boron≤0.001%, 0%≤Magnesium≤0.0010%, 0%≤Titanium≤0.01%, with 0.3%≤Mo+V+Nb≤0.6%, the remainder composition being composed of iron and unavoidable impurities, the microstructure of steel sheet including in area fraction, 70% to 90% Bainite, 10% to 25% Ferrite wherein the cumulated amounts of Bainite and Ferrite is at least 90% and a cumulated amount of Residual Austenite and Martensite is between 0% and 10%.

19 Claims, No Drawings

(56) References Cited

FOREIGN PATENT DOCUMENTS

| | | | |
|---|---|---|---|
| JP | 2016050335 | A | 4/2016 |
| WO | WO2017102982 | A1 | 6/2017 |
| WO | WO2017108866 | A1 | 6/2017 |
| WO | WO2017125809 | A1 | 7/2017 |
| WO | WO2018115935 | A1 | 6/2018 |
| WO | WO 2018115936 | A1 | 6/2018 |
| WO | WO2020058829 | | 3/2020 |

OTHER PUBLICATIONS

International Search Report of PCT/IB2019/0057381, dated Sep. 25, 2019.

* cited by examiner

HOT ROLLED STEEL SHEET AND A METHOD OF MANUFACTURING THEREOF

The present invention relates to hot rolled steel sheets suitable for use as steel sheet for automobiles.

BACKGROUND

Automotive parts are required to satisfy two inconsistent necessities: ease of forming and strength. However in recent years a third requirement of improvement in fuel consumption is also bestowed upon automobiles in view of global environment concerns. Thus, now automotive parts must be made of material having high formability to fit the criteria of ease of fit in the intricate automobile assembly and at the same time improve strength for vehicle crashworthiness and durability while reducing the weight of the vehicle to improve fuel efficiency.

Therefore, intense Research and development endeavors are put in to reduce the amount of material utilized in a car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for appreciation of the present invention:

EP 1138796 claims for a hot-rolled steel with very high elasticity limit and mechanical resistance usable in particular for auto parts production, characterized by the following composition by weight: 0.08%<carbon<0.16%, 1%<manganese<2%, 0.02%<aluminum<0.1%, silicon<0.5%, phosphorus<0.03%, sulfur<0.01%, vanadium<0.3%, chromium<1%, nitrogen<0.015%, molybdenum<0.6%. But the steel of EP1138796 does not demonstrate a have hole expansion ratio which is essential for manufacturing of auto parts.

EP2171112 is an invention that relates to a hot-rolled steel sheet having a resistance higher than 800 MPa and an elongation at break higher than 10%, and having the following composition in weight: 0.050%≤C≤0.090%, 1%<Mn≤2%, 0.015%≤Al≤0.050%, 0.1%≤Si≤0.3%, 0.10%≤Mo≤0.40%, S≤0.010%, P≤0.025%, 0.003%≤N≤0.009%, 0.12%≤V≤0.22%, Ti≤0.005%, Nb≤0.020% and optionally Cr≤0.45%, the balance consisting of iron and unavoidable impurities resulting from the production, wherein the microstructure of the sheet or the part includes, in surface fraction, at least 80% of upper bainite, the optional balance consisting of lower bainite, martensite and residual austenite, the sum of the martensite and residual austenite contents being lower than 5%. But this invention is also unable to demonstrate the hole expansion ratio required for auto parts.

SUMMARY OF THE INVENTION

It is an object of the present invention to provide hot rolled steel sheets that simultaneously have:

- a tensile strength greater than or equal to 940 MPa and preferably above 960 MPa,
- a total elongation greater than or equal to 8% and preferably above 9%.
- a hole expansion ratio of greater than or equal to 40% and preferably above 45%

In a preferred embodiment, the steel sheets according to the invention may also present a yield strength 750 MPa or more.

In a preferred embodiment, the steel sheets according to the invention may also present a yield strength to tensile strength ratio of 0.5 or more.

Preferably, such steel can also have a good suitability for forming, in particular for rolling with good weldability and coatability.

The present invention provides a hot rolled steel sheet having a composition comprising of the following elements, expressed in percentage by weight:

0.11%≤Carbon≤0.16%
1%≤Manganese≤2%
0.1%≤Silicon≤0.7%
0 02%≤Aluminum≤0.1%
0.15%≤Molybdenum≤0.4%
0.15%≤Vanadium≤0.4%
0.002%≤Phosphorus≤0.02%
0%≤Sulfur≤0.005%.
0%≤Nitrogen≤0.01% and can contain one or more of the following optional elements

0%≤Chromium≤0.5%
0%≤Niobium≤0.05%
0.0001%≤Calcium≤0.005%
0%≤Boron≤0.001%
0%≤Magnesium≤0.0010%
0%≤Titanium≤0.01%
with 0.3%≤Mo+V+Nb≤0.6% the remainder composition being composed of iron and unavoidable impurities caused by processing, the microstructure of said steel sheet comprising in area fraction, 70% to 90% Bainite, 10% to 25% Ferrite wherein the cumulated amounts of Bainite and Ferrite is at least 90% and a cumulated amount of Residual Austenite and Martensite is between 0% and 10%.

Another object of the present invention is also to make available a method for the manufacturing of these sheets that is compatible with conventional industrial applications while being robust towards manufacturing parameters shifts.

A method of production of a hot rolled heat treated steel sheet comprising the following successive steps includes:

- providing the steel composition above;
- reheating semi-finished product having to a temperature between 1200° C. and 1300° C.;
- rolling the said semi-finished product in the austenitic range wherein the hot rolling finishing temperature shall be between 850° C. and 975° C. to obtain a hot rolled steel strip;
- then cooling the said hot rolled strip in three step cooling wherein:
  - the step one of cooling the hot rolled steel sheet starts from a temperature range between 850° C. and 975° C. to a temperature range between 650° C. and 725° C., with a cooling rate between 40° C./s and 150° C./s;
  - the step two of cooling the hot rolled steel sheet starts from a temperature range between 650° C. and 725° C. to a temperature range between 620° C. and 690° C., said step two having a duration of 1 s to 10 s and being an air cooling the step three of cooling the hot rolled steel sheet starts from a temperature range between 620° C. and 690° C. to a temperature range between 450° C. and 550° C.; with a cooling rate greater than 20° C./s thereafter coiling the said hot rolled steel strip at a temperature range between 450° C. and 550° C.;

cooling the coiled hot rolled steel strip to room temperature.

DETAILED DESCRIPTION

The hot rolled steel sheet of the present invention may optionally be coated with zinc or zinc alloys, to improve its corrosion resistance.

Carbon is present in the steel between 0.11% and 0.16%. Carbon is an element necessary for increasing the strength of the steel sheet by controlling the ferrite formation and carbon also impart the steel with strength by precipitate strengthening by forming Vanadium Carbide or Niobium Carbides, therefore, Carbon plays a pivotal role in increasing the strength. But Carbon content less than 0.11% will not be able to impart the tensile strength to the steel of the present invention. On the other hand, at a Carbon content exceeding 0.16%, the steel exhibits poor spot weldability which limits its application for the automotive parts. A preferable content for the present invention may be kept between 0.11% and 0.15%

Manganese content of the steel of the present invention is between 1% and 2%. This element is gammagenous and also influence Bs and Ms temperatures therefore plays an important role in controlling the Ferrite formation. The purpose of adding Manganese is essentially to impart hardenability to the steel. An amount of at least 1% by weight of Manganese has been found in order to provide the strength and hardenability to the steel sheet. But when Manganese content is more than 2% it produces adverse effects such as retarding transformation of Austenite during the cooling after hot rolling. In addition, the Manganese content of above 1.8% promotes the central segregation hence reduces the formability and also deteriorates the weldability of the present steel. A preferable content for the present invention may be kept between 1.3% and 1.8%, Silicon content of the steel of the present invention is between 0.1% and 0.7%. Silicon is solid solution strengthener especially for microstructures Ferrite and Bainite. In addition, a higher content of Silicon can retard the precipitation of Cementite. However, disproportionate content of Silicon leads to a problem such as surface defects like tiger strips which adversely effects the coatability of the steel of present invention. Therefore, the concentration is controlled within an upper limit of 0.7%. A preferable content for the present invention may be kept between 0.2% and 0.6%.

Aluminum is an element that is present in the steel of the present invention between 0.02% and 0.1%. Aluminum is an alphagenous element and imparts ductility to steel of the present invention. Aluminum in the steel has a tendency to bond with nitrogen to form aluminum nitride hence from point of view of the present invention the Aluminum content must be kept as low as possible and preferably between 0.02% and 0.06%.

Molybdenum is an essential element that constitutes 0.15% to 0.4% of the Steel of the present invention; Molybdenum increases the hardenability of the steel of the present invention and influences the transformation of austenite to Ferrite and Bainite during cooling after hot rolling. However, the addition of Molybdenum excessively increases the cost of the addition of alloy elements, so that for economic reasons its content is limited to 0.4%. Preferable limit for molybdenum is between 0.15% and 0.3%.

Vanadium is an essential element that constitutes between 0.15% and 0.4% of the steel of the present invention. Vanadium is effective in enhancing the strength of steel by forming carbides, nitrides or carbo-nitrides and the upper limit is 0.4% due to the economic reasons. These carbides, nitrides or carbo-nitrides are formed during the second and third step of cooling. The preferable limit for Vanadium is between 0.15% and 0.3%.

Phosphorus constituent of the steel of the present invention is between 0.002% and 0.02%. Phosphorus reduces the spot weldability and the hot ductility, particularly due to its tendency to segregate at the grain boundaries or co-segregate with manganese. For these reasons, its content is limited to 0.02% and preferably lower than 0.015%.

Sulfur is not an essential element but may be contained as an impurity in steel and from point of view of the present invention the Sulfur content is preferably as low as possible, but is 0.005% or less from the viewpoint of manufacturing cost. Further if higher Sulfur is present in steel it combines to form Sulfides especially with Manganese and reduces its beneficial impact on the steel of present invention, therefore preferred below 0.003%

Nitrogen is limited to 0.01% in order to avoid ageing of material, nitrogen forms the nitrides which impart strength to the steel of present invention by precipitation strengthening with Vanadium and Niobium but whenever the presence of nitrogen is more than 0.01% it can form high amount of Aluminum Nitrides which are detrimental for the present invention hence the preferable upper limit for nitrogen is 0.005%.

Chromium is an optional element for the present invention. Chromium content may be present in the steel of present invention between 0% and 0.5%. Chromium is an element that provides hardenability to the steel but higher content of Chromium higher than 0.5% leads to central co-segregation similar to Manganese.

Niobium is an optional element for the present invention. Niobium content may be present in the steel of present invention between 0% and 0.05% and is added in the steel of present invention for forming carbides or carbo-nitrides to impart strength to the steel of present invention by precipitation strengthening.

Calcium content in the steel of present invention is between 0.0001% and 0.005%. Calcium is added to steel of present invention as an optional element especially during the inclusion treatment, thereby, retarding the harmful effects of Sulfur.

$$0.3 \leq Mo+V+Nb \leq 0.6$$

The cumulative presence of Molybdenum, Vanadium and Niobium is kept between 0.3% and 0.6% to impart the steel of the present invention with strength and hole expansion ratio as both Niobium and Vanadium form nitrides, carbo-nitrides or carbides whereas Molybdenum ensures the formation of adequate ferrite, hence this equation supports the present invention to strike a balance between tensile strength by ensuring formation of precipitates and imparts hole expansion ratio by ensuring adequate ferrite.

Other elements such as, Boron or Magnesium can be added individually or in combination in the following proportions by weight: Boron≤0.001%, Magnesium≤0.0010%. Up to the maximum content levels indicated, these elements make it possible to refine the grain during solidification.

Titanium is a residual element and can be present up to 0.01%.

The remainder of the composition of the Steel consists of iron and inevitable impurities resulting from processing.

The microstructure of the Steel sheet comprises:

Bainite constitutes from 70% to 90% of microstructure by area fraction for the Steel of the present invention. Bainite constitutes the primary phase of the steel as a matrix and cumulatively consists of Upper Bainite and Lower Bainite. To ensure tensile strength of 940 MPa and preferably 960 MPa or more it is necessary to have 70% of Bainite. Bainite starts forming during the third cooling step and forms till the coiling.

Ferrite constitutes from 10% to 25% of microstructure by area fraction for the Steel of present invention. Ferrite cumulatively comprises of Polygonal ferrite and acicular ferrite. Ferrite imparts elongation as well as formability to the steel of the present invention. To ensure an elongation of 8% and preferably 9% or more it is necessary to have 10% of Ferrite. Ferrite is formed during the cooling after hot rolling in steel of present invention. But whenever ferrite content is present above 25% in steel of the present invention the tensile strength is not achieved.

The cumulated amount of bainite and ferrite is greater than 90% to ensure a balance between strength and formability. Cumulative presence of Bainite and Ferrite impart tensile strength of 940 MPa due to the presence of Bainite and Ferrite ensure the formability.

Martensite and Residual Austenite are optional constituents for the steel of the present invention and may be present between 0% and 10% cumulatively by area fraction and are found in traces. Martensite for the present invention includes both fresh martensite and tempered martensite. Martensite imparts strength to the Steel of the present invention. When Martensite is in excess of 10% it imparts excess strength and the yield strength goes beyond acceptable upper limit. In a preferred embodiment, the cumulated amount of martensite and residual austenite is between 2 and 10%.

In addition to the above-mentioned microstructure, the microstructure of the hot rolled steel sheet is free from microstructural components, such as Pearlite and Cementite but may be found in traces.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling.

The temperature of the slab, which is subjected to hot rolling, is preferably at least 1200° C. and must be below 1300° C. In case the temperature of the slab is lower than 1200° C., excessive load is imposed on a rolling mill. Therefore, the temperature of the slab is preferably sufficiently high so that hot rolling can be completed in the in 100% austenitic range. Reheating at temperatures above 1275° C. must be avoided because it causes productivity loss and is also industrially expensive. Therefore, the preferred reheating temperature is between 1200° C. and 1275° C.

Hot rolling finishing temperature for the present invention is between 850° C. and 975° C. and preferably between 880° C. and 930° C.

The hot rolled strip obtained in this manner is then cooled in three step cooling process wherein the step one of cooling starts immediately after the finishing of hot rolling and in the step one the hot rolled strip is cooled from finishing of hot rolling to a temperature range between 650° C. and 720° C. at a cooling rate between 40° C./s and 150° C./s. In a preferred embodiment, the cooling rate for the step one of cooling is between 40° C./s and 120° C./s.

Thereafter the step two of cooling starts from temperature range between 650° C. and 725° C. for a time period between 1 second and 10 seconds, preferably between 2 and 9 seconds, and the step two stops between 620° C. and 690° C. During this step the cooling is done by Air cooling and the time limit is decided in accordance to the foreseen ferrite microstructure for the steel to be manufactured further during this step the ferrite microstructure is formed and the micro-alloying elements such as Vanadium and/or Niobium forms Nitrides, carbides and carbo-nitrides to impart strength to the steel.

Then the step three of cooling starts from a temperature range between 620° C. and 690° C. to the coiling temperature range which is between 450° C. and 550° C. at a cooling rate greater than 20° C./s. In this step of cooling the bainite transformation starts and this bainite transformation kept on going till the coiled hot rolled strip crosses the Ms temperature while cooling and thereafter the bainite transformation stops. In a preferred embodiment, the coiling temperature range is between 470° C. and 530° C.

Thereafter coiling the hot rolled strip between the temperature range 450° C. and 550° C. and preferably between 470° C. and 530° C. Then cooling the coiled hot rolled strip to room temperature to obtain a hot rolled steel sheet.

EXAMPLES

The following tests, examples, figurative exemplification and tables which are presented herein are non-restricting in nature and must be considered for purposes of illustration only, and will display the advantageous features of the present invention.

Steel sheets made of steels with different compositions are gathered in Table 1, where the steel sheets are produced according to process parameters as stipulated in Table 2, respectively. Thereafter Table 3 gathers the microstructures of the steel sheets obtained during the trials and table 4 gathers the result of evaluations of obtained properties.

TABLE 1

| Steels | C | Mn | Si | Al | Mo | V | P | S | N | Cr | Nb | Ca | Ti | Mo + V + Nb |
|---|---|---|---|---|---|---|---|---|---|---|---|---|---|---|
| A | 0.120 | 1.59 | 0.20 | 0.033 | 0.30 | 0.185 | 0.016 | 0.0030 | 0.0060 | 0.37 | 0.01 | 0.004 | 0 | 0.495 |
| B | 0.133 | 1.62 | 0.21 | 0.031 | 0.31 | 0.190 | 0.015 | 0.0030 | 0.0040 | 0.37 | 0.01 | 0.003 | 0 | 0.510 |
| C | 0.122 | 1.63 | 0.40 | 0.050 | 0.21 | 0.200 | 0.010 | 0.0030 | 0.0050 | 0.40 | 0.01 | 0.001 | 0 | 0.420 |
| D | 0.080 | 1.90 | 0.49 | 0.030 | 0.21 | 0.010 | 0.012 | 0.0015 | 0.0035 | 0.30 | 0.03 | 0.001 | 0.15 | 0.250 |
| E | 0.175 | 1.65 | 0.75 | 0.850 | 0.01 | 0.010 | 0.010 | 0.0005 | 0.0030 | 0.05 | 0.01 | 0.001 | 0 | 0.030 |
| F | 0.120 | 2.25 | 0.40 | 0.040 | 0.20 | 0.200 | 0.010 | 0.0030 | 0.0050 | 0.41 | 0.01 | 0.001 | 0 | 0.410 |

I = according to the invention;

R = reference;

underlined values: not according to the invention.

TABLE 2

| | | | | Step 1 | | | Step 2 | | | | Step 3 | | | |
|---|---|---|---|---|---|---|---|---|---|---|---|---|---|---|
| Trials | Steel | Reheating T (° C.) | HR Finish T (° C.) | Cooling start T (° C.) | Cooling stop T (° C.) | Cooling rate (° C./s) | Cooling start T (° C.) | Time to cooling stop T (s) | Cooling type | Cooling stop T (° C.). | Cooling start T (° C.) | Cooling stop T (° C.) | Cooling rate (° C/.s) | Coiling T (° C.) |
| I1 | A | 1260 | 895 | 895 | 660 | 105 | 660 | 6 | Air cooling | 650 | 650 | 470 | 45 | 470 |
| I2 | B | 1250 | 875 | 875 | 680 | 85 | 680 | 4 | Air cooling | 675 | 675 | 495 | 35 | 495 |
| I3 | C | 1260 | 910 | 910 | 660 | 105 | 660 | 6 | Air cooling | 650 | 650 | 470 | 45 | 470 |
| I4 | A | 1250 | 875 | 875 | 680 | 85 | 680 | 4 | Air cooling | 675 | 675 | 495 | 35 | 495 |
| I5 | B | 1240 | 910 | 910 | 670 | 80 | 670 | 5 | Air cooling | 665 | 665 | 520 | 30 | 520 |
| I6 | C | 1250 | 975 | 975 | 680 | 85 | 680 | 4 | Air cooling | 675 | 675 | 495 | 35 | 495 |
| R1 | B | 1250 | 910 | 910 | 615 | 75 | 615 | 7 | Air cooling | 605 | 605 | 525 | 25 | 525 |
| R2 | C | 1260 | 865 | 865 | 615 | 85 | 0 | 0 | — | — | — | — | — | 615 |
| R3 | D | 1250 | 875 | 875 | 680 | 85 | 680 | 4 | Air cooling | 675 | 675 | 495 | 35 | 495 |
| R4 | E | 1260 | 875 | 875 | 660 | 105 | 660 | 6 | Air cooling | 650 | 650 | 470 | 45 | 470 |
| R5 | F | 1240 | 910 | 910 | 670 | 80 | 670 | 5 | Air cooling | 665 | 665 | 520 | 30 | 520 |

I = according to the invention;
R =reference;
underlined values: not according to the invention.

Table 2 gathers the process parameters implemented on steels of Table 1.

TABLE 3

| Trials | Ferrite (%) | Bainite (%) | RA + Martensite (%) | Bainite + Ferrite |
|---|---|---|---|---|
| I1 | 17 | 80 | 3 | 97 |
| I2 | 12 | 80 | 8 | 92 |
| I3 | 20 | 71 | 9 | 91 |
| I4 | 12 | 82 | 6 | 94 |
| I5 | 18 | 75 | 7 | 93 |
| I6 | 12 | 80 | 8 | 92 |
| R1 | 29 | 67 | 4 | 96 |
| R2 | 35 | 58 | 7 | 93 |
| R3 | 50 | 40 | 10 | 90 |
| R4 | 40 | 38 | 22 | 78 |
| R5 | 15 | 67 | 18 | 82 |

I = according to the invention; R = reference; underlined values: not according to the invention.

Table 3 exemplifies the results of the tests conducted in accordance with the standards on different microscopes such as Scanning Electron Microscope for determining the microstructures of both the inventive and reference steels.

The results are stipulated herein:

Table 4

Table 4 exemplifies the mechanical properties of both the inventive steel and reference steels. In order to determine the tensile strength, yield strength and total elongation, tensile tests are conducted in accordance of JIS Z2241 standards.

The results of the various mechanical tests conducted in accordance to the standards are gathered

TABLE 4

| Trials | Tensile Strength (MPa) | Yield Strength (MPa) | Total Elongation (%) | Hole Expansion ratio (%) |
|---|---|---|---|---|
| I1 | 977 | 846 | 13 | 45 |
| I2 | 1002 | 884 | 10 | 58 |
| I3 | 1011 | 882 | 9.5 | 42 |
| I4 | 983 | 857 | 12 | 51 |
| I5 | 994 | 868 | 11.5 | 42 |
| I6 | 998 | 866 | 11 | 54 |
| R1 | 920 | 832 | 10 | 48 |
| R2 | 912 | 823 | 14 | 35 |
| R3 | 889 | 809 | 14 | 68 |

TABLE 4-continued

| Trials | Tensile Strength (MPa) | Yield Strength (MPa) | Total Elongation (%) | Hole Expansion ratio (%) |
|---|---|---|---|---|
| R4 | 860 | 675 | 13 | 46 |
| R5 | 1026 | 824 | 10 | 26 |

I = according to the invention; R = reference; underlined values: not according to the invention.

What is claimed is:

1. A hot rolled steel sheet having a composition consisting of the following elements, expressed in percentage by weight:

0.11%≤Carbon≤0.16%,
1%≤Manganese≤2%,
0.1%≤Silicon≤0.7%,
0 02%≤Aluminum≤0.1%,
0.15%≤Molybdenum≤0.4%,
0.15%≤Vanadium≤0.4%,
0.002%≤Phosphorus≤0.02%,
0%≤Sulfur≤0.005%,
0%≤Nitrogen≤0.01%,
0%≤Chromium≤0.5%,
0%≤Niobium≤0.05%,
0.0001%≤Calcium≤0.005%,
0%≤Boron≤0.001%,
0%≤Magnesium≤0.0010%,
with 0.3%≤Mo+V+Nb≤0.6%, a remainder of the composition being composed of iron and unavoidable impurities, a microstructure of the hot rolled steel sheet comprising in area fraction, 70% to 90% Bainite, 10% to 25% Ferrite, wherein a cumulated amount of Bainite and Ferrite is at least 90% and a cumulated amount of Residual Austenite and Martensite is between 0% and 10%.

2. The hot rolled steel sheet as recited in claim 1 wherein the composition has 0.2% to 0.6% of Silicon, in percentage by weight.

3. The hot rolled steel sheet as recited in claim 1 wherein the composition has 0.11% to 0.15% of Carbon, in percentage by weight.

4. The hot rolled steel sheet as recited in claim 3 wherein the composition has 0.15% to 0.3% of Vanadium, in percentage by weight.

5. The hot rolled steel sheet as recited in claim 1 wherein the composition has 1.3% to 1.8% of Manganese, in percentage by weight.

6. The hot rolled steel sheet as recited in claim 1 wherein the composition has 0.15% to 0.3% of Molybdenum, in percentage by weight.

7. The hot rolled steel sheet as recited in claim 1 wherein the composition has 0.02% to 0.06% of Aluminum, in percentage by weight.

8. The hot rolled steel sheet as recited in claim 1 wherein the cumulated amount of Residual Austenite and Martensite is between 2% and 10% in area fraction.

9. The hot rolled steel sheet as recited in claim 1 wherein said steel sheet has a tensile strength of 950 MPa or more, and a hole expansion ratio of 40% or more.

10. The hot rolled steel sheet as recited in claim 9 wherein said steel sheet has a tensile strength of 960 MPa or more and a total elongation of 8% or more.

11. A structural or safety part of a vehicle comprising the hot rolled steel sheet as recited in claim 1.

12. A vehicle comprising the structural or safety part as recited in claim 11.

13. A method of production of the hot rolled heat treated steel sheet as recited in claim 1 comprising the following successive steps:

providing a semi-finished product having a steel composition consisting of the following elements, expressed in percentage by weight:

0.11%≤Carbon≤0.16%,
1%≤Manganese≤2%,
0.1%≤Silicon≤0.7%,
0.02%≤Aluminum≤0.1%,
0.15%≤Molybdenum≤0.4%,
0.15%≤Vanadium≤0.4%,
0.002%≤Phosphorus≤0.02, %
0%≤Sulfur≤0.005%,
0%≤Nitrogen≤0.01%,
0%≤ Chromium≤0.5%,
0%≤Niobium≤0.05%,
0.0001%≤Calcium≤0.005%,
0%≤Boron≤0.001%,
0%≤Magnesium≤0.0010%,
with 0.3%≤Mo+V+Nb≤0.6%, a remainder of the composition being composed of iron and unavoidable impurities;

reheating the semi-finished product to a reheating temperature between 1200° C. and 1300° C.;

rolling the semi-finished product in an austenitic range wherein a hot rolling finishing temperature is between 850° C. and 975° C. to obtain a hot rolled steel strip; then cooling the hot rolled steel strip in three step cooling wherein:

in step one of the cooling, cooling starts at a temperature in a temperature range between 850° C. and 975° C. and ends at a temperature in a temperature range between 650° C. and 725° C., with a cooling rate between 40° C./s and 150° C./s;

in step two of the cooling, cooling starts at a temperature in a temperature range between 650°° C. and 725°° C. and ends at a temperature in a temperature range between 620° C. and 690° C., said step two having a duration of 1 s to 10 s and being an air cooling; and in step three of the cooling, cooling starts at a temperature in a temperature range between 620° C. and 690°° C. and ends at a temperature in a temperature range between 450°° C. and 550° C. with a cooling rate greater than 20° C./s; thereafter coiling the hot rolled steel strip at a coiling temperature in a range between 450° C. and 550°° C. to obtain a coiled hot rolled steel strip;

cooling the coiled hot rolled steel strip to room temperature to obtain the hot rolled heat treated steel sheet as recited in claim 1.

14. The method as recited in claim 13 wherein the reheating temperature for semi-finished product is between 1200° C. and 1275° C.

15. The method as recited in claim 13 wherein the hot rolling finishing temperature is between 880°° C. and 930° C.

16. The method as recited in claim 13 wherein the coiling temperature range is between 470° C. and 530° C.

17. The method as recited in claim 13 wherein the cooling rate for the step one of the cooling is between 40° C./s and 120° C./s.

18. The method as recited in claim 13 wherein the cooling rate for the step three of the cooling is greater than equal to 25° C./s.

19. The method as recited in claim 13 wherein the duration for the step two of the cooling is between 2 seconds and 9 seconds.

* * * * *